US008343017B2

(12) United States Patent
Dellino

(10) Patent No.: US 8,343,017 B2
(45) Date of Patent: Jan. 1, 2013

(54) STRIKE TRAINING MACHINE WITH BIDIRECTIONAL WEIGHT RESISTANCE

(75) Inventor: Fabio Dellino, Bellaria-Igea Marina (IT)

(73) Assignee: Fabio Dellino, Bellaria-Igea Marina, Rimini (IT)

( * ) Notice: Subject to any disclaimer, the term of this patent is extended or adjusted under 35 U.S.C. 154(b) by 455 days.

(21) Appl. No.: 12/768,591

(22) Filed: Apr. 27, 2010

(65) Prior Publication Data

US 2011/0263390 A1 Oct. 27, 2011

(51) Int. Cl.
*A63B 69/34* (2006.01)

(52) U.S. Cl. ..... 482/83; 482/86; 482/87

(58) Field of Classification Search ..... 482/83–90; 434/247

See application file for complete search history.

(56) References Cited

U.S. PATENT DOCUMENTS 4,653,746 A 3/1987 Brunier
5,624,362 A 4/1997 Wilson
6,685,581 B2 2/2004 Krause
6,827,674 B1 12/2004 Ferry
7,329,210 B1 * 2/2008 Marano ..... 482/83
7,628,742 B2 12/2009 Weaver
7,959,542 B1 * 6/2011 Trudeau ..... 482/83
2006/0100067 A1 5/2006 Washburn
2009/0264263 A1 10/2009 Yang
2011/0256990 A1 * 10/2011 Machado et al. ..... 482/83

* cited by examiner

*Primary Examiner* — Glenn Richman
(74) *Attorney, Agent, or Firm* — Los Angeles Patent Group; Arman Katiraei

(57) ABSTRACT

Some embodiments include a strike training machine that provides bidirectional resistance. The machine replicates the full and natural trajectory of the striking motion and provides resistance throughout extension and contraction of the striking motion. In this manner, the machine trains all muscles involved in a particular strike. The trajectory of the machine is user adjustable to accommodate different striking motions which include punches, kicks, elbow strikes, knee strikes, and throwing motions. In some embodiments, the machine applies a user specifiable amount of resistance. By adjusting the amount of resistance, the actor is able to overload train the muscle groups associated with the striking motions by gradually increasing resistance during training.

17 Claims, 14 Drawing Sheets

STRIKE TRAINING MACHINE WITH BIDIRECTIONAL WEIGHT RESISTANCE

TECHNICAL FIELD

The present invention relates to a strike training machine. More particularly, this invention relates to a weight training machine that provides bidirectional resistance training for striking motions.

BACKGROUND ART

Striking motions, such as punching and kicking, are basic elements to any form of martial arts, self-defense, or boxing. As with any athletics or sports motion, an effective strike requires the actor to develop strength, quickness, and technique in his strikes. A variety of devices and tools have been developed to assist in the training of these striking motions.

A punching bag is a common strike training tool in boxing. The punching bag is a weighted bag (e.g., up to several hundred pounds) that is suspended from above using a swinging chain. In some implementations, the punching bag is suspended atop a base that retains the punching bag upright when in use.

The punching bag has several shortcomings for effective strike training. Firstly, the punching bag requires time to reset to a default stationary position after it has been struck. Once struck, the punching bag oscillates from its point of suspension or from its base depending on the force of the strike. This movement makes it difficult to quickly perform repetitions using the same form or technique. As a result, form and technique vary with each subsequent strike. Secondly, the weight of the punching bag cannot be easily adjusted since it is filled with sand, water, or other substance in its core. The weight of the punching bag therefore remains constant and progressive overload training cannot be accomplished. Thirdly, the fixed weight of the punching bag does not provide effective strike training for actors of different strengths. For instance, performing strikes on a punching bag that is too heavy can result in injury to the actor. When the punching bag is too heavy, the force of the strike is halted at the point of impact resulting in excess stress on the bones and joints of the actor. The actor is also unable to complete the full range of the strike motion thereby minimizing the effectiveness of the training. Conversely, performing strikes on a punching bag that is too light yields little to no strength or quickness training.

Strike training tools also include a pad that is held by a first actor so that a second actor may perform strikes to the pad. Since the pad is supported by a user and not a movable weight stack, the resistance encountered when performing the strikes is neither constant nor progressive. Furthermore, the actor performing the strikes is unable to perform the full range of motion of the strike since the pad is held in a mostly stationary position. Consequently, the actor performing the strikes is unable to perform a full strike motion with constant or progressive resistance throughout the strike. As a result, these tools also do not provide effective strength or quickness training.

Resistance cables have also been used in strike training. For example, the actor grabs a handle that is attached via a cable and a set of pulleys to a weight stack. When the actor performs a punching motion while grabbing the handle, the cable becomes taught and the weight stack provides resistance against the punching motion of the actor. However, instead of pushing with the fist as would occur in a natural punching motion, the actor is pulling on the cable while grabbing a handle. The pulling results in an unnatural application of force. Specifically, the counter force or resistance provided by the weight stack is distributed by pulleys connecting the cable to a weight stack that is often located behind the actor's body, usually above the actor's head or behind the actor's feet. By placing the resistance behind the body position of the user, the machine improperly develops the muscles and technique. This increases the risk of injury to the actor.

Moreover, a natural punching motion encounters resistance at the point of impact which is in front of the fist. The natural resistance remains in front of the fist throughout the entire punching motion requiring the actor to produce a push force rather than a pull force. Accordingly, these machines also do not accurately replicate the striking motion since the actor does not perform the punching strike with a proper closed fist. There is no impact placed on the knuckles. The resistance force is instead placed on the palm of the hand grabbing the handle. As noted above, these variations increase the risk of injury to the user.

Typical weight training machines also do not provide effective strike training. These machines are primarily used to isolate and train specific muscles groups using confined movements. The movements performed on these machines do not replicate the full range of a striking motion. The machines can therefore cause the muscles to develop improperly for a striking motion, thereby increasing the risk of injury to the actor performing the striking motions. Furthermore, multiple machines would have to be used to target and train each of the several muscles that are used simultaneously in one striking motion.

Accordingly, there is a need for a weight training machine that replicates the full range of the most common striking motions used in martial arts, self-defense, and boxing. There is a need for such a machine to provide bidirectional resistance throughout the full range of the striking motion (i.e., extension and contraction) in order to develop strength, quickness, and technique for the strike. The machine should provide an easily adjustable amount of resistance in order to offer overload training.

SUMMARY OF THE INVENTION

Some embodiments include a strike training machine that provides bidirectional resistance. The machine simultaneously trains all muscles involved in a particular strike by replicating the full and natural motion of the particular strike. In some embodiments, the angle of movement of the strike training machine is user adjustable to accommodate different striking motions and techniques. Accordingly, the strike training machine may be used to train punches, kicks, elbow strikes, knee strikes, and throwing motions used in martial arts, self defense, and boxing. By replicating the motion of a punching strike, the machine develops the punching strike technique as well as strength and quickness in the muscles used by the arm, shoulder, chest, back, and core to throw the punching strike. Similarly, by replicating the motion of a kicking strike, the machine develops the kicking technique as well as strength and quickness in the muscles used by the leg, hips, and core to throw the kicking strike.

Throughout the striking motion (i.e., extension and contraction), the machine provides an amount of resistance. The machine requires the actor to produce a push force sufficient to overcome the resistance throughout the full range of the striking motion. In some embodiments, the amount of resistance is user specifiable. By adjusting the amount of resistance, the actor is able to overload train the muscles associated with a particular striking motion through gradual increases of resistance.

In some embodiments, the machine includes a frame, a strike pad, a support member, rotating frame extensions, a weight assembly, and a frame. The strike pad is attached to the support member and it provides the contact point between the actor and the strike training machine. The strike pad accurately replicates the impact of a strike. For example, the actor uses a closed fist and encounters impact along the knuckles when performing a punching strike.

The support member spans vertically over the rotating frame extensions. The frame extensions couple to the support member at one end using a first pair of rotating hinges and couple to the frame at another end using a second pair of rotating hinges. The frame extensions are positioned at an acute angle relative to the vertical position of the frame and rotate about the hinges. The rotation of the frame extensions facilitates axial movement of the support member and strike pad along an x-axis when a push force is applied to the strike pad.

The weight assembly attaches to the rotating frame extensions and extend towards the front of the frame along outward facing sides of the frame extensions. The weight assembly extends at an acute angle relative to a vertical position of the frame and retains the acute angle throughout the rotation of the frame extensions. In this manner, the weight assembly generates a counter-force or resistance to a push force applied at the strike pad. The actor controls the amount of resistance by increasing or decreasing the amount of weight that is placed on the weight assembly.

When a sufficient push force to overcome the resistance is applied to the strike pad using a particular strike, the strike pad and support member move along the x-axis. The frame extensions rotate at the hinges to facilitate the axial movement. Throughout this movement, the machine applies a constant amount of resistance to the actor generated push force. When the actor begins to recoil the strike and the push force is progressively reduced, the resistance applied by the weight assembly causes the frame extensions to rotate back to the default starting position. The actor resists against the return rotation thereby providing resistance training along the contraction of the strike as well.

The actor can then perform additional repetitions using the same technique and form as in the previous motion. It should be apparent to one of ordinary skill in the art that the strike training machine of some embodiments may be used to train a variety of strikes including punching strikes, kicking strikes, elbow strikes, knee strikes, shoulder strikes, head strikes, throwing motions, and shot-put motions as some examples.

BRIEF DESCRIPTION OF THE DRAWINGS

In order to achieve a better understanding of the nature of the present invention a preferred embodiment of the strike training machine will now be described, by way of example only, with reference to the accompanying drawings in which.

DETAILED DESCRIPTION OF THE INVENTION

In the following detailed description of the invention, numerous details, examples, and embodiments of the strike training machine are set forth and described. However, it will be clear and apparent to one skilled in the art that the strike training machine is not limited to the embodiments set forth and that the strike training machine may be practiced without some of the specific details and examples discussed.

Some embodiments include a strike training machine that provides bidirectional resistance for strike training. Unlike traditional weight training machines that isolate and train specific muscles or muscle groups, the strike training machine trains all muscles involved in a particular strike by requiring the actor to perform the full and natural range of motion of the particular strike. For each strike, the machine applies resistance at the point of contact, extension, contraction, and recoil. Accordingly, for a punching strike, the strike training machine provides bidirectional resistance to train the muscles of the arm, shoulder, chest, back, and core that are involved in the extension, contraction, and recoil of the punching strike.

Martial arts, self-defense, and boxing strikes utilize strikes that produce a push force at and through the point of contact. The strike training machine of some embodiments replicates the production of the push force when performing a strike. The strike training machine provides a weight assembly and a strike pad. The strike pad is positioned in front of the weight assembly. The actor applies a push force against the strike pad when performing a striking motion. At the point of contact, the weight assembly produces a push force that counters the push force of the actor thereby creating resistance to train the muscles utilized in the striking motion.

This is unlike resistance cable training where, when the actor performs a striking motion, the actor generates a pull force that that pulls one or more cables connected to a weight stack that is located behind the actor instead of in front of the actor. Moreover, the strike training machine applies a constant amount of resistance throughout the striking motion whereas resistance cable training applies a variable amount of resistance that increases the more the cables are stretched.

The amount of resistance provided by the strike training machine of some embodiments is adjustable by increasing and decreasing weight on the weight assembly. In this manner, the actor is able to overload train the muscle groups associated with a particular strike by progressively increasing amounts of resistance.

I. Strike Weight Training Machine

Figure 1:
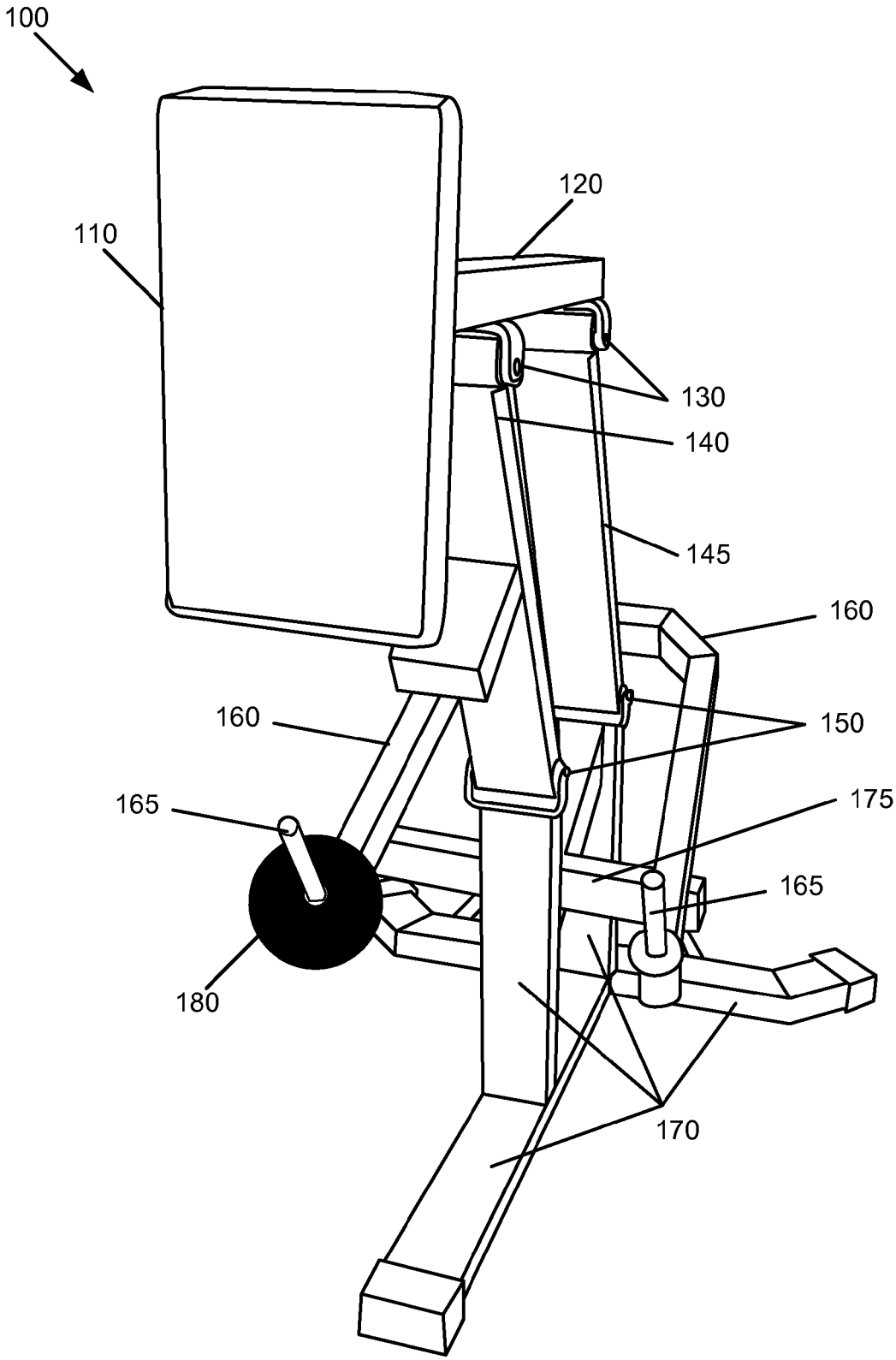
FIG. 1 illustrates a strike training machine from a side angle in accordance with some embodiments.

FIG. 1 illustrates a strike training machine 100 from a side angle in accordance with some embodiments. The machine 100 includes: (1) strike pad 110, (2) support member 120, (3) first pair of rotating hinges 130, (4) rotating frame extensions 140 and 145, (5) second pair of rotating hinges 150, (6) weight assembly 160 with pegs 165, and (7) frame 170.

The strike pad 110 is a rectangular shaped cushion that absorbs the push force generated from various striking motions. It should be apparent that the strike pad 110 may be of various shapes including circular, oblong, and square. Some examples of strikes that can be performed against the strike pad 110 include various punches, kicks, shot-put motions, throwing motions, elbow strikes, knee strikes, shoulder strikes, and head strikes. The strike pad 110 acts as the point of contact between the actor's strike and the machine 100.

In some embodiments, the strike pad 110 measures one to three feet in length and one to three feet in width. The strike pad 110 is located three to six feet above the ground. In some embodiments, the height and angle of the strike pad 110 is user adjustable as described in detail below with reference to FIGS. 8 and 12.

The strike pad 110 is coupled to the support member 120. The strike pad 110 may be coupled to the support member 120 using a set of nuts and bolts or by welding the strike pad 110 to the support member 120.

The support member 120 spans across the top of each of the rotating frame extensions 140 and 145. In some embodiments, the length of the support member 120 is user adjustable. For example, the support member 120 is composed of two separate shafts that fit within one another. Each shaft contains a set of holes. The user sets the length by aligning the holes of the outer and inner shaft and secures the length using a pin that slides into the holes of both shafts.

The support member 120 couples to each of the rotating frame extension 140 and 145 using the first pair of rotating hinges 130. Each of the first pair of rotating hinges 130 includes a first hinge bracket that is attached to the support member 120 and a second hinge bracket that is attached to one of the rotating frame extensions 140 and 145. The two brackets of the support member 120 are aligned with each bracket of the rotating frame extensions 140 and 145. Nut and bolt assemblies are used to secure the brackets.

A second pair of rotating hinges 150 couple the rotating frame extensions 140 and 145 to the frame 170. As with the first pair of hinges 130, a bracket attached to the bottom of each rotating frame extension 140 and 145 is aligned with a bracket attached to the frame 170 and nut and bolt assemblies are used to secure the brackets.

The hinges 130 allow for the support member 120 to rotate about the frame extensions 140 and 145. The hinges 150 allow for the frame extensions 140 and 145 to rotate about the frame 170. Together, these rotations produce axial movement in the strike pad 110 and support member 120 when a push force is applied to the strike pad 110.

Figure 10:
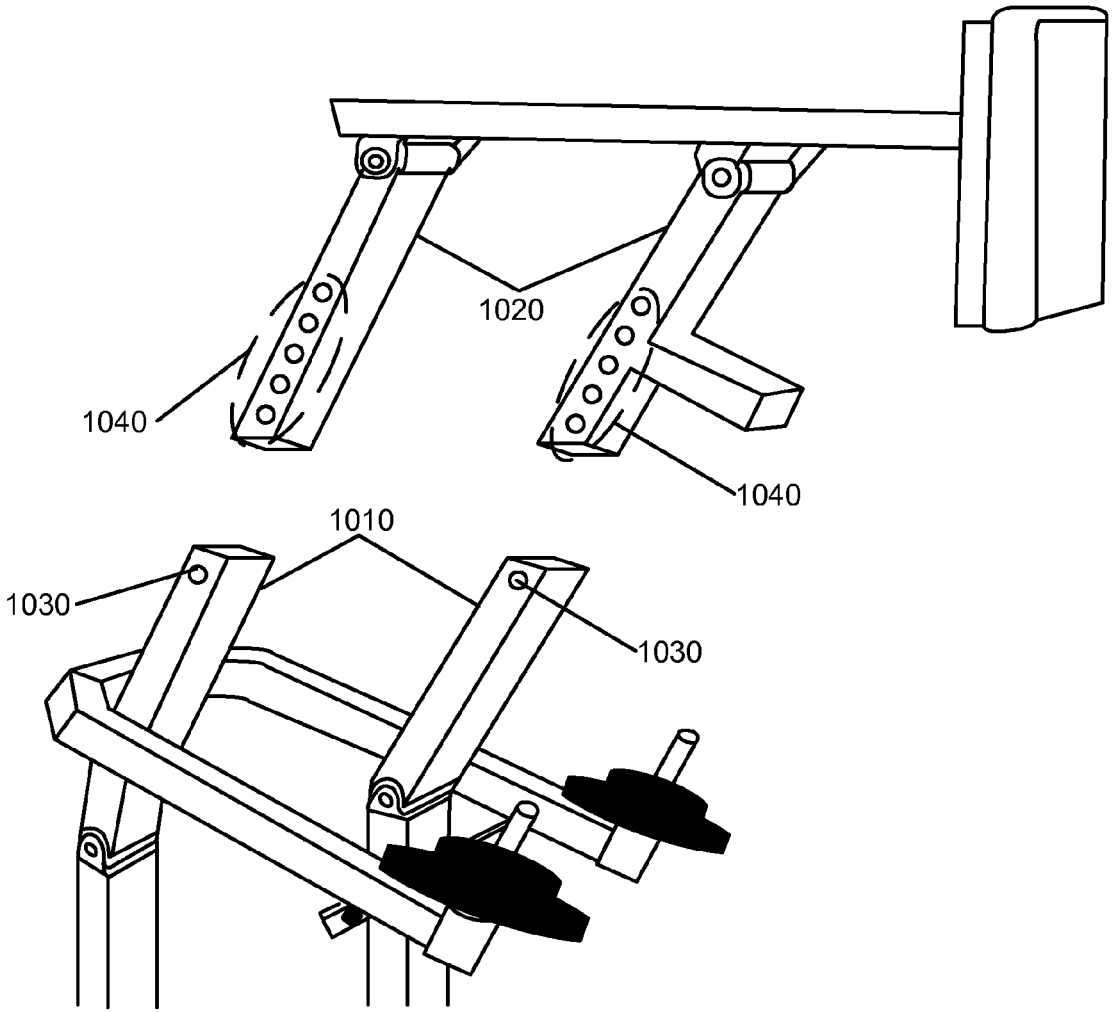
FIG. 10 illustrates adjusting the angle of the axial movement of the strike pad in accordance with some embodiments of the strike weight training machine.

In some embodiments, the height of each frame extension 140 and 145 is user adjustable as described in further detail with reference to FIGS. 10-11 below. By adjusting the heights of the frame extensions, the user alters the trajectory of the movement of the strike pad. This adapts the movement of the strike pad to the movement of a particular strike. For example, a particular straight punching strike may extend only along the x-axis whereas a particular kicking strike extends along the x and y axes. In this manner, the strike training machine of some embodiments adapts to the full range of motion of many common strikes thereby replicating the motion while also providing bidirectional resistance with the weight assembly 160.

The weight assembly 160 provides a counter push force or resistance to the push force applied to the strike pad 110. The weight assembly 160 includes pegs 165 on which weights may be placed to increase the resistance. As an example, a weight 180 is placed on one of the pegs 165.

The weight assembly 160 is located behind the strike pad 110 and is attached to the rear frame extension 145. The weight assembly 160 moves in conjunction with the rear frame extension 145. In some embodiments, the weight assembly 160 is angled zero to 45 degrees below a perpendicular extension from the rear frame extension 145.

When a force is applied to the strike pad 110 that causes an axial movement of the strike pad 110, the rear frame extension 145 rotates towards the back of the machine 100. This rotation elevates the weight assembly 160 and any weight coupled to the pegs 165. Therefore, the greater the amount of weight on the weight assembly 160, the greater the push force that must be applied at the strike pad 110 to produce the axial movement.

The frame 170 provides a foundation that stabilizes and supports the strike pad 110, support member 120, rotating frame extensions 140 and 145, and the weight assembly 160. The frame 170 prevents sideways movement and forwards and backwards movement of the machine 100 when in use.

The frame 170 includes bar 175 that defines a default position for the machine 100 when the machine 100 is not in use. The bar 175 is located below the weight assembly 160 and includes rubber stops upon which the weight assembly 160 rests when the machine 100 is not in use. The bar 175 prevents the rotating frame extensions 140 and 145 from rotating past the default position.

In some embodiments, each of the support member 120, rotating frame extensions 140 and 145, weight assembly 160, and frame 170 are composed of one or more welded steel segments. It should be apparent to one of ordinary skill in the art that these components may be composed of any other rigid material such as aluminum or composite materials.

Figure 2:
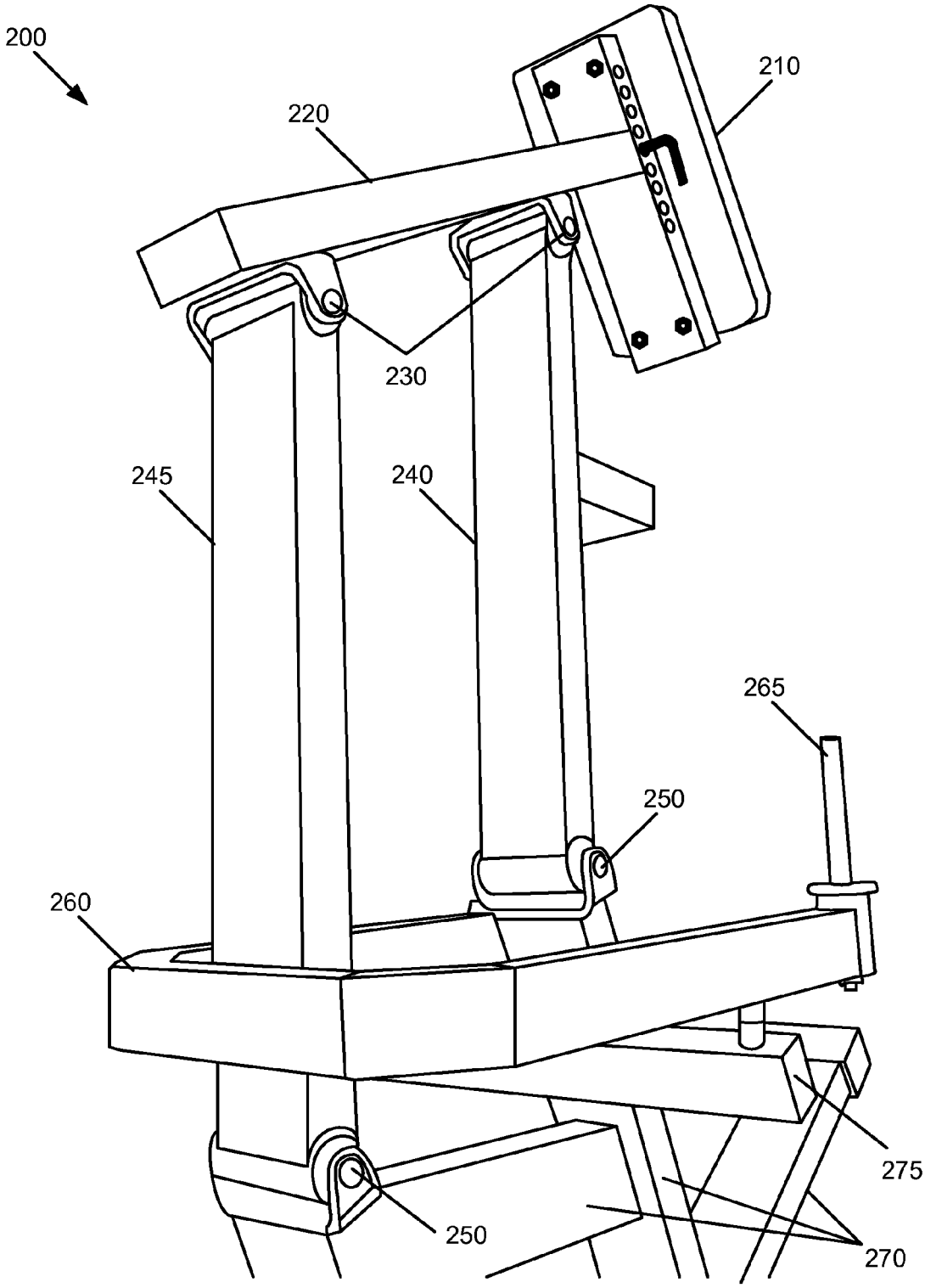
FIG. 2 presents a rear view of the strike training machine of some embodiments.

FIG. 2 presents a rear view of the strike training machine 300 of some embodiments. As in FIG. 1 above, the machine includes (1) strike pad 210, (2) support member 220, (3) first pair of rotating hinges 230, (4) rotating frame extensions 240 and 245, (5) second pair of rotating hinges 250, (6) weight assembly 260 with pegs 265, and (7) frame 270 including bar 275 that defines a default position for the machine 200 when the machine 200 is not in use.

II. Operation

Figure 3:
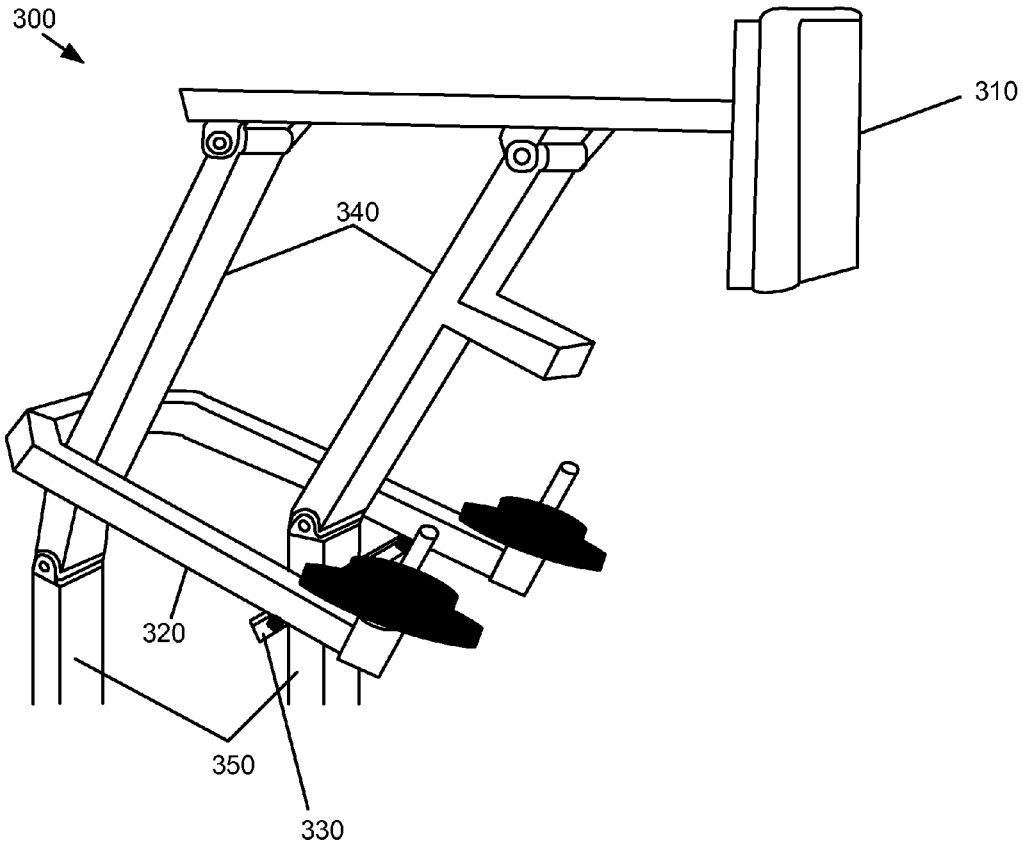
FIG. 3 illustrates the strike training machine at a default resting position in accordance with some embodiments.
Figure 4:
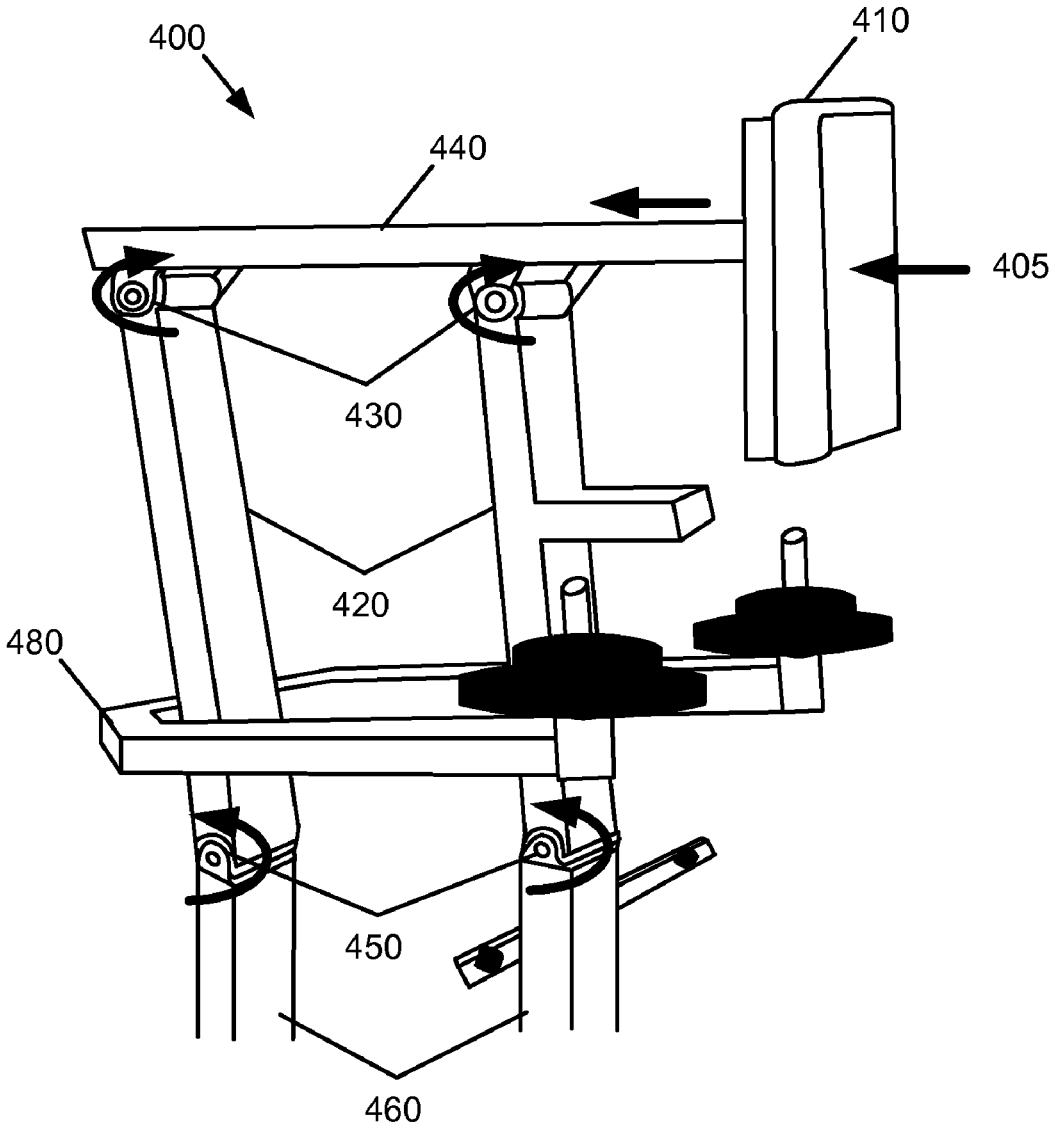
FIG. 4 illustrates the strike training machine of some embodiments after an actor performs a striking motion that applies force to the strike pad causing axial movement of the strike pad.

FIGS. 3 and 4 illustrates movement of the strike training machine 300 when force is applied to the strike pad 310 in accordance with some embodiments. Specifically, FIG. 3 illustrates the strike training machine 300 in a default resting position and FIG. 4 illustrates the strike training machine 400 after an actor performs a striking motion that applies force to the strike pad 410 causing axial movement of the strike pad 410.

In FIG. 3, the machine 300 is at a default stationary position. The weight assembly 320 is resting atop the bar 330. The machine 300 returns to the default position when not in use due to the position of and force generated by the weight assembly 320. Specifically, the weight assembly 320 is angled acutely relative to the vertical extension of the frame 350. This positioning produces a force that causes the rotating frame extensions 340 to rotate towards the front of the machine 300 brining the weight assembly 320 to rest atop the bar 330.

In FIG. 4, a push force 405 is applied to the strike pad 410. The push force 405 may be generated using any one of a variety of different strikes (e.g., punch, kick, elbow, knee, etc.). The push force 405 causes the strike pad 410 to travel towards the rear of the machine 400. This movement is facilitated by the rotation of the frame extensions 420. Specifically, the force applied to the strike pad 410 causes the hinges 430 that connect the support member 440 to the frame extensions 420 to rotate in a clockwise motion and the hinges 450 that connect the frame extensions 420 to the frame 460 to rotate in a counter-clockwise motion. As a result, the angle of the frame extensions 420 increases relative to the vertical extensions of the frame 460. As the angle increases, the strike pad 410 and the support member 440 move along an x-axis toward the rear of the machine 400. It should be apparent to one of ordinary skill in the art that the rotation of the frame extensions 420 may also produce some movement of the strike pad 410 along a y-axis.

The axial movement of the strike pad 410 follows the natural extension of the strike. Upon contraction of the strike, the resistance of the weight assembly 480 causes the hinges 430 and 450 to rotate the frame extensions 420 back to the initial default position shown in FIG. 3. By resisting against the counter push force during contraction, the actor obtains bidirectional resistance training for the striking motion. It should be apparent that throughout the entire motion (i.e., extension and contraction), a constant amount of resistance is provided according to the amount of weight that is placed on the weight assembly 480.

The actor is able to perform additional repetitions of the striking motion without having to adjust the technique or form of the striking motion. This is in contrast to a punching bag in which the first strike causes the punching bag to oscillate along the x, y, and z axes. After contraction of the strike, the punching bag continues to oscillate. The actor must then modify his technique or form to make contact with the punching bag again.

It should be apparent that when using the strike training machine of some embodiments, an actor is able to easily modify the contact point of the striking motion. For example, by placing a fist against the strike pad while the arm is fully cocked to throw a punch, the actor creates a contact point before the striking punch motion begins. In this configuration, resistance is encountered throughout the entire range of the punch extension and contraction. Alternatively, the actor may stand a distance from the strike pad such that the contact point between the actor's fist and strike pad occurs halfway through the punching strike. This enables the actor to generate momentum before encountering resistance at the strike pad.

Figure 5:
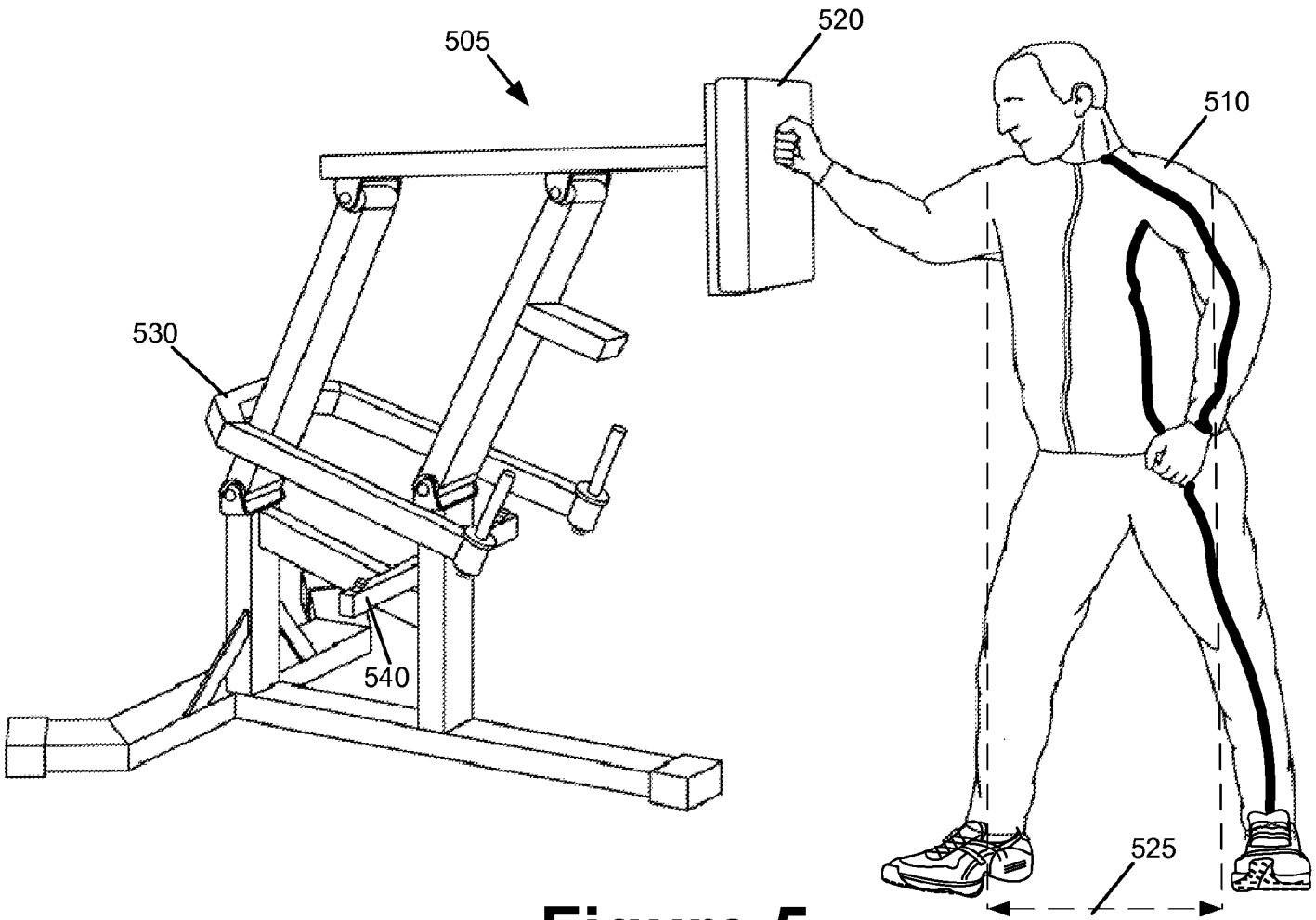
FIG. 5 illustrates use of the strike training machine in accordance with some embodiments.

FIG. 5 illustrates use of the strike training machine 505 in accordance with some embodiments. The figure illustrates an actor 510 having commenced delivering a punching strike to the strike pad 520 of the machine 505.

The actor 510 positions his body in the same position as if performing the strike on another human or object. For example, martial artists position their bodies in their corresponding martial arts' stance and boxers assume a boxing stance. This is contrast to other strike training machines or tools that require the user to be in an artificial strike position (e.g., seated, inclined, etc.).

In this figure, the actor 510 positions his feet approximately shoulder-width apart 525 for balance and contacts the strike pad 520 with his right fist. The actor 510 delivers a push force with his fist against the strike pad 520 causing axial movement of the strike pad 520. As shown, the push force delivered by the actor 510 has caused the weight assembly 530 to elevate off the bar 540.

Figure 6:
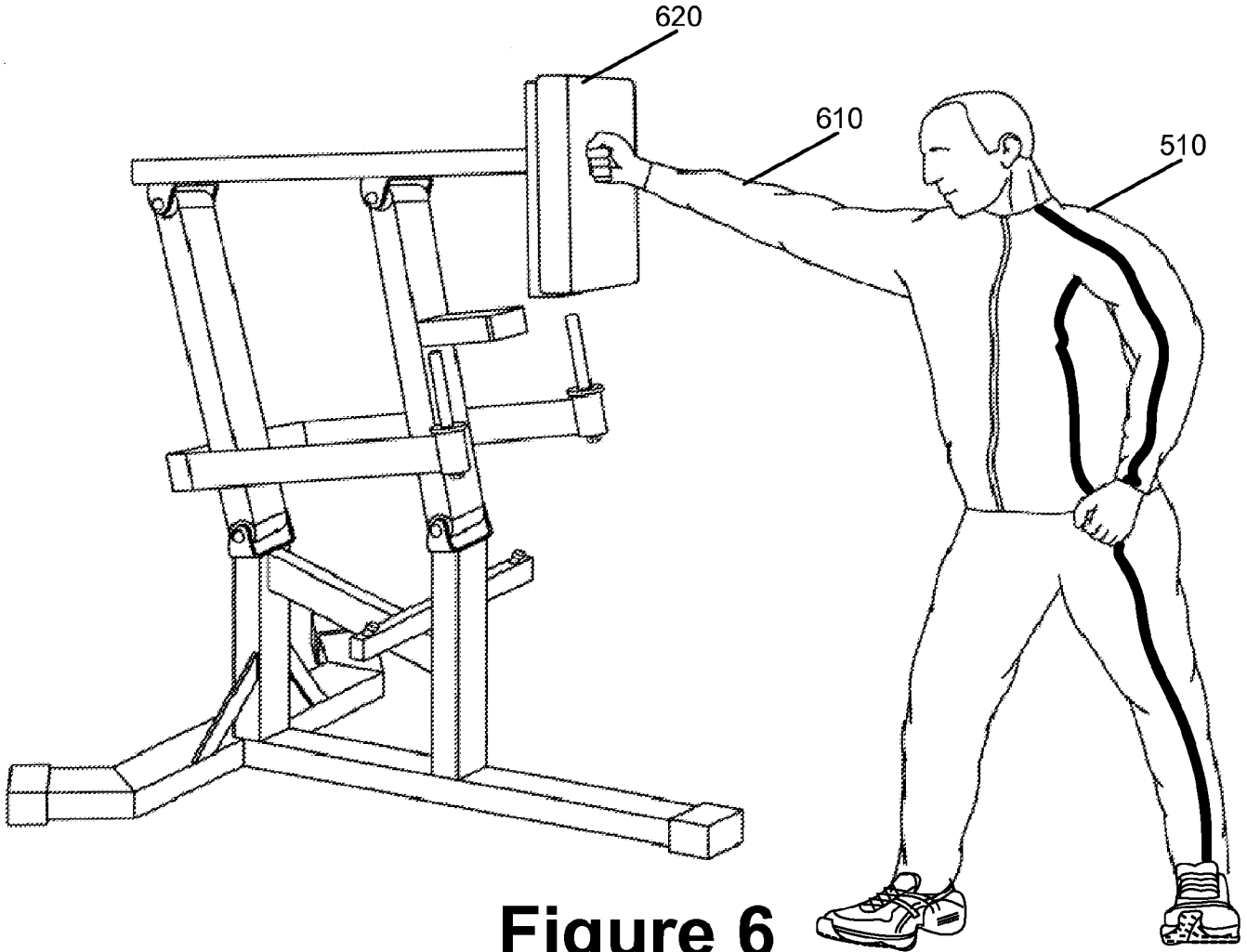
FIG. 6 illustrates the actor from FIG. 5 having completed a full extension of the punching strike.

FIG. 6 illustrates the actor 510 from FIG. 5 having completed a full extension of the punching strike. As shown in FIG. 6, the arm 610 of the actor 510 is now fully extended while the fist retains its position against the strike pad 620. The strike pad 620 has moved further towards the rear of the machine and has elevated a distance along the y-axis to follow the natural extension of the punching strike. Accordingly, the machine has replicated the natural motion of the punching strike while delivering a constant amount of resistance throughout the motion.

The actor contracts the striking motion after completing the strike extension. FIG. 5 may also be used illustrates the actor's body position and the position of the strike training machine upon completing the contraction motion of a punching strike.

During contraction, the actor continues to train the muscles used during the extension. Specifically, the strike pad applies a counter push force at the contact point when the actor performs the contraction motion. By resisting against the counter push force during the contraction, the actor continues to exert a push force using opposite motions of the same muscle groups used in the strike. In this manner, the strike training machine of some embodiments provides bidirectional resistance which in turn facilitates bidirectional training of the muscles used in any particular striking motion.

It should be apparent that the amount of resistance applied by the strike training machine of some embodiments is constant throughout the full range of motion. This is in contrast to resistance cables that gradually increase resistance as the cables becomes more taught and decrease resistance as the cables become looser.

Moreover, the resistance applied by the strike training machine replicates the resistance encountered by an actor when performing the strike on another human or object. Specifically, the position of the weight assembly behind the strike pad provides a counter push force throughout the motion of the strike. In this manner, the muscles used in the striking motion are accurately trained using the same distribution of stress applied to each muscle as when actually performing the strike on another human or object.

Machines that utilize cables that attach to a weight stack using a set of pulleys deliver resistance from behind the actor and often from above or below the actor. This results in improper delivery of resistance and improper training of the muscles used in the strike. The actor unconsciously modifies his technique to account for the improper distribution of stress to the muscles used in the strike. For example, when performing a straight punching strike with resistance that is delivered from above and behind the actor, the actor stresses the shoulder muscles more than if the resistance was delivered from behind and in parallel with the strike. Similarly, when performing a straight punching strike with resistance being delivered from below the actor (e.g., by his feet), the actor stresses the triceps muscles more than if the resistance was delivered from behind and in parallel with the strike. The improper distribution of stress increases the risk of injury to the actor.

After each striking motion, the actor may repeat the motion without altering form or technique. Specifically, the fist remains at the same position on the strike pad during multiple repetitions of the punching motion. The actor may also alternate the arm used in the punching strike after each strike. In this manner, the actor achieves balanced training of the muscles used in striking with either arm. The actor may also use both arms at the same time to simulate a pushing motion. It should be apparent that the actor may similarly repeat kicking strikes with the same leg or alternate legs at each strike.

Figure 7:
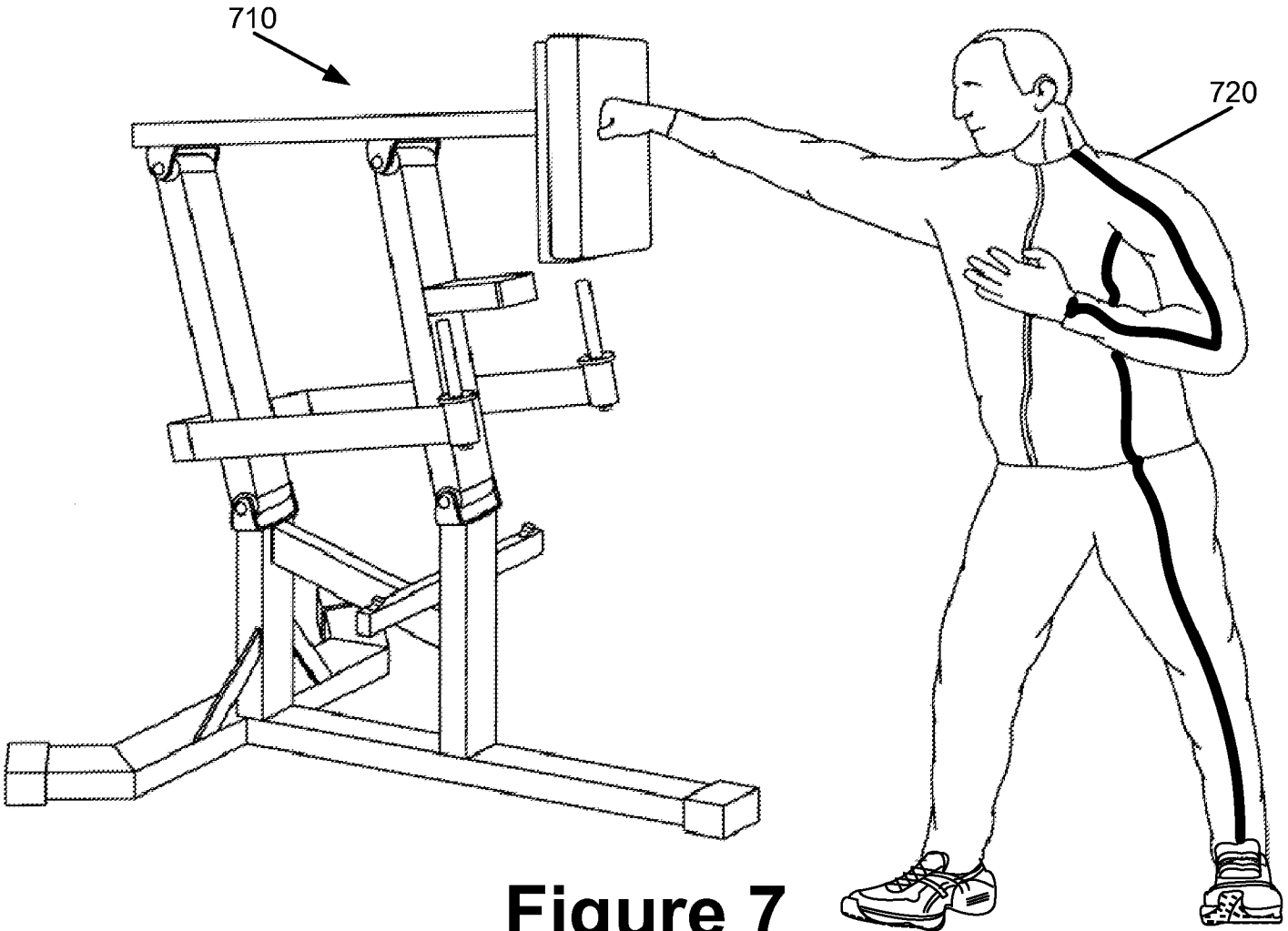
FIG. 7 illustrates using the strike training machine of some embodiments to train a different punch strike motion than the punch strike motion performed by the actor of FIGS. 5 and 6.

The strike training machine of some embodiments may also be used to train a variety of different striking motions separately or in sequence. For example, an actor may perform a punch, kick, punch combination of strikes against the strike pad in one sequence without modifying the machine configuration. Each punch in the sequence may include a different punch technique. FIG. 7 illustrates using the strike training machine 710 of some embodiments to train a different punch strike motion than the punch strike motion performed by the actor 510 of FIGS. 5 and 6.

In FIG. 7, the actor 720 performs a punch striking motion with the palm of the striking hand facing downwards and the knuckles of the striking hand facing upwards. In FIGS. 5 and 6, the actor 510 performs a punch striking motion with the palm and knuckles of the striking hand facing sideways.

FIG. 7 is presented as one example of several different strike techniques that the actor can train using the strike training machine of some embodiments. Some other examples include using the strike training machine of some embodiments to train a variety of striking techniques used in jeet kune do (JKD), kung-fu, boxing, karate, taekwondo, krav-maga, kick boxing, ju-jutsu, etc. These strike techniques may include various punches, kicks, elbow strikes, knee strikes, head strikes, and throws as some examples.

III. Configuration Adjustments

In some embodiments, the strike training machine is user configurable to adjust to different striking motions and actors of different heights and lengths. FIGS. 8-13 illustrate various configuration adjustments that may be made to some embodiments of the strike training machine.

Figure 8:
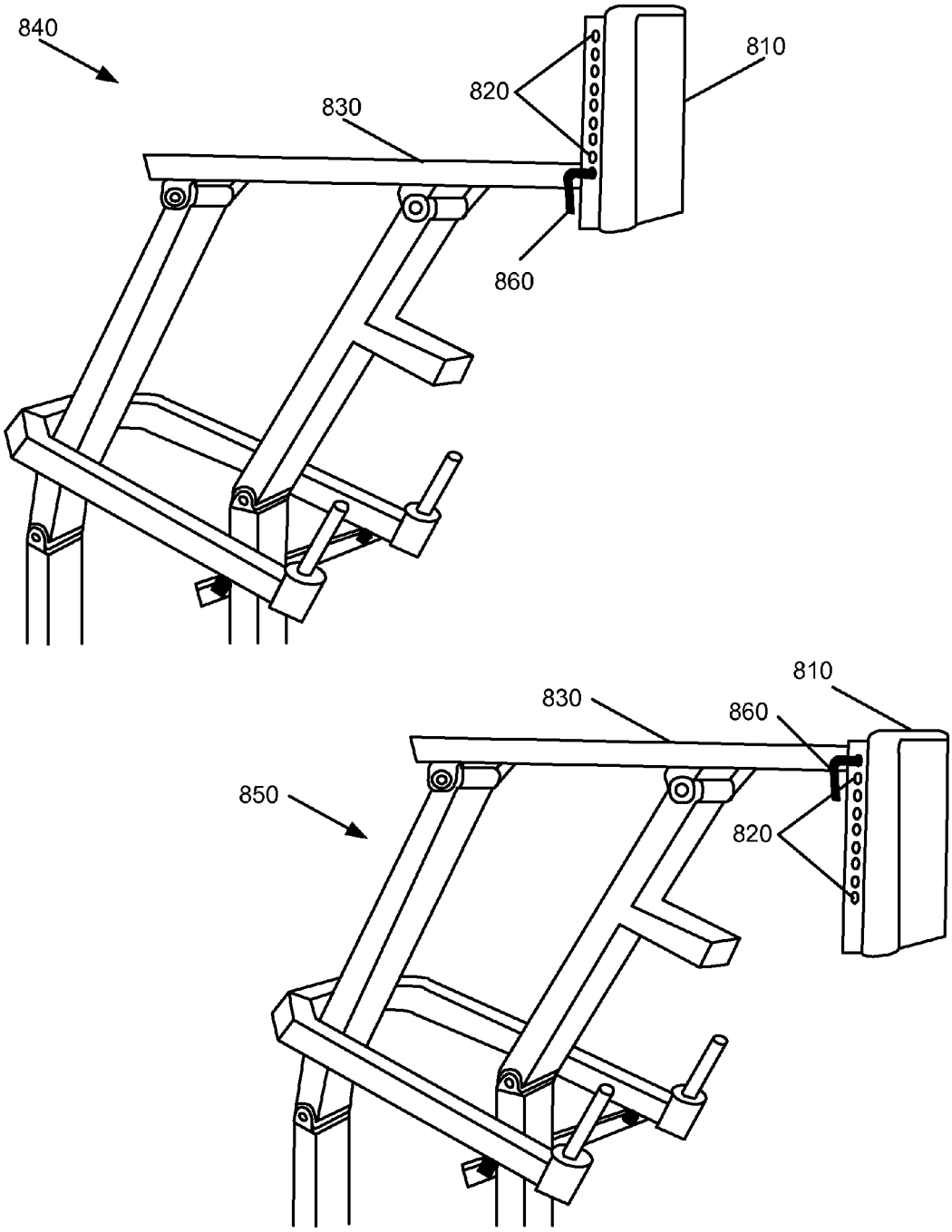
FIG. 8 illustrates an adjustable height strike pad in accordance with some embodiments of the strike weight training machine.

FIG. 8 illustrates an adjustable height strike pad 810 in accordance with some embodiments of the strike weight training machine. The strike pad 810 includes a set of pre-drilled holes 820 that align with a hole at the end of the support member 830 (not shown). The actor adjusts the height of the strike pad by selecting a particular hole from the set of holes 820 to align with the hole at the end of the support member 830.

To raise the height of the strike pad 810, the actor selects a hole near the bottom of the strike pad 810 to align with the hole of the support member 830 as shown at 840. To lower the height of the strike pad 810, the actor selects a hole near the top of the strike pad 810 to align with the hole of the support member 830 as shown at 850.

The actor fixes the position of the strike pad 810 relative to the support member 830 using pin 860. Specifically, the pin 860 is inserted through each of the aligned holes thereby preventing further movement of the strike pad 810.

Figure 9A:
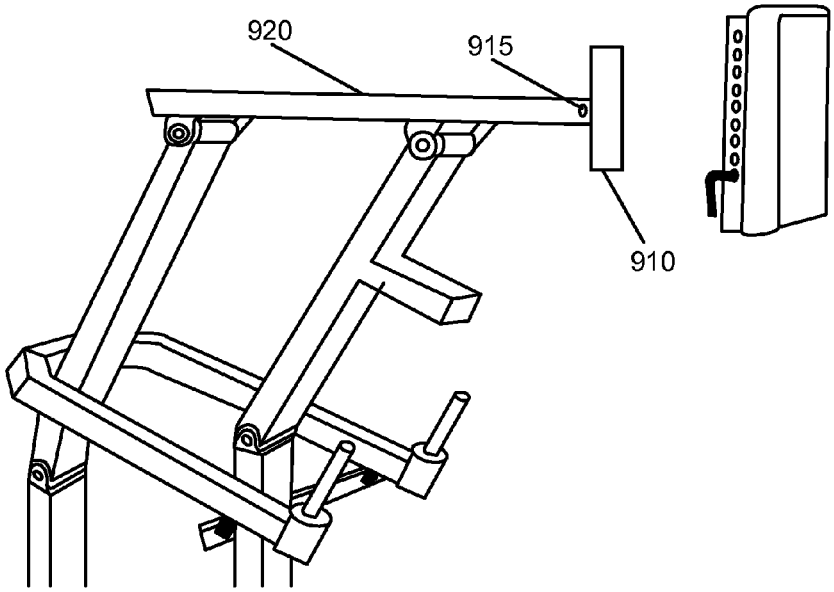
FIG. 9A illustrates a stabilizing plate and hole at the end of the support member in accordance with some embodiments.
Figure 9B:
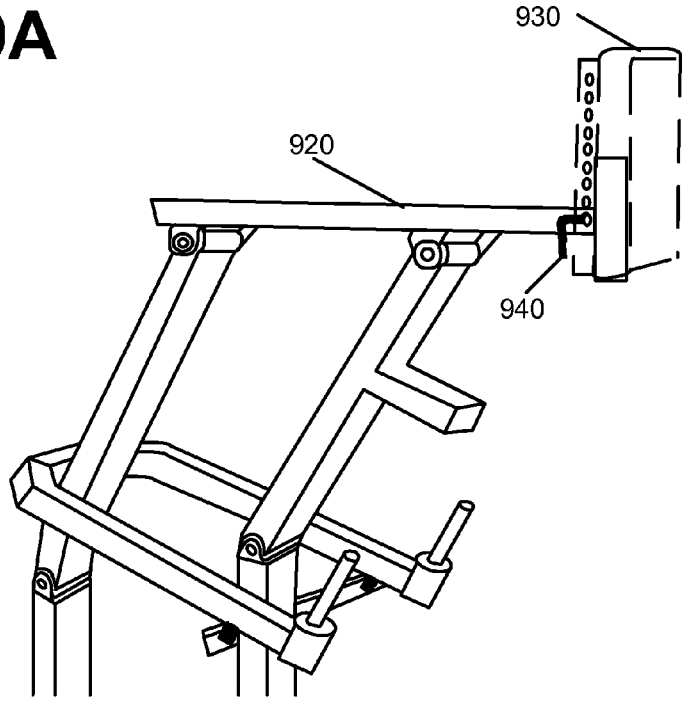
FIG. 9B illustrates the strike pad coupled to the support member with a pin in accordance with some embodiments.

In some such embodiments, the end of the support member 830 includes a stabilizing plate to prevent movement of the strike pad 810 once a height is selected. FIG. 9A illustrates the stabilizing plate 910 and hole 915 at the end of the support member 920. FIG. 9B illustrates the strike pad 930 coupled to the support member 920 with pin 940.

In some embodiments, the angle of the axial movement of the strike pad may be adjusted. FIG. 10 illustrates adjusting the angle of the axial movement of the strike pad in accordance with some embodiments of the strike weight training machine.

In this figure, each of the rotating frame extensions is composed of an inner shaft 1010 and an outer shaft 1020. The outer shaft 1020 slides over the inner shaft 1010. The inner shaft 1010 includes a single hole 1030 and the outer shaft 1020 includes a set of holes 1040. The height of each frame extension may be adjusted by aligning a particular hole of the outer shaft 1020 to the hole 1030 of the inner shaft 1010 and securing the height with a pin. Each height configuration alters the axial movement of the strike pad.

Figure 11:
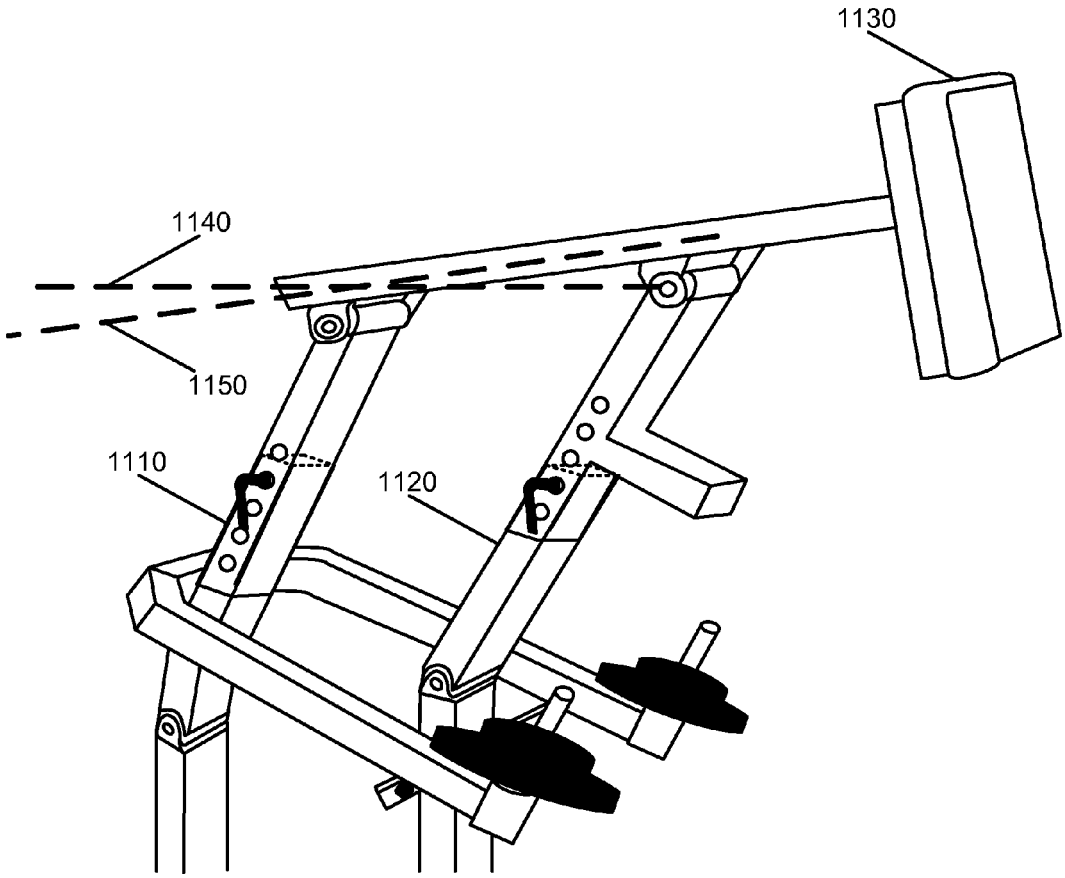
FIG. 11 illustrates axial movement of the strike pad when the frame extensions of the strike training machine are of differing heights in accordance with some embodiments.

FIG. 11 illustrates axial movement of the strike pad when the frame extensions of the strike training machine are of differing heights in accordance with some embodiments. As shown, the height of the rear frame extension 1110 is less than the height of the front frame extension 1120. When force is applied to the strike pad 1130, the strike pad 1130 moves along the x-axis as before, however the strike pad 1130 also moves downwards along the y-axis due to the height difference between the frame extensions 1110 and 1120.

The difference in the axial movement is illustrated by lines 1140 and 1150. Line 1140 illustrates the axial movement of the strike pad 1130 when the frame extensions are of equal height. Line 1150 illustrates the axial movement of the strike pad 1130 based on the different heights of the frame extensions 1110 and 1120 in FIG. 11.

An actor can reverse the heights of the frame extensions (e.g., 1110 higher than 1120) such that the strike pad 1130 moves in an upward or incline motion along the y-axis as force is applied along the strike pad 1130. In this manner, the strike training machine of some embodiments adjusts to the motion of several different strikes. For example, a first configuration provides training for an upward extending kick and a second configuration provides training for a downward extending punch.

In some embodiments, the heights of the frame extensions or strike pad may be lowered or raised to train different strikes. For example, to perform a knee strike, the actor lowers the frame extensions and the strike pad so that the strike pad is at waist level. The actor may then raise the frame extensions and the strike pad so that strike pad is at shoulder level in order to perform elbow strikes.

In some embodiments, the angle of the strike pad may be adjusted to coincide with the change in the axial movement of the strike pad and support member when the frame extensions are of differing heights. Accordingly, when performing an upward kicking strike, the actor can (1) adjust the angle at which the strike pad moves when contacted by the kicking strike and (2) adjust the angle of the strike pad so that the strike pad is aligned with the position of the actor's foot at the contact point and throughout the kick extension. In this manner, the actor's foot remains in a natural position throughout the kicking motion thereby reducing the risk of injury to the ankle.

Figure 12:
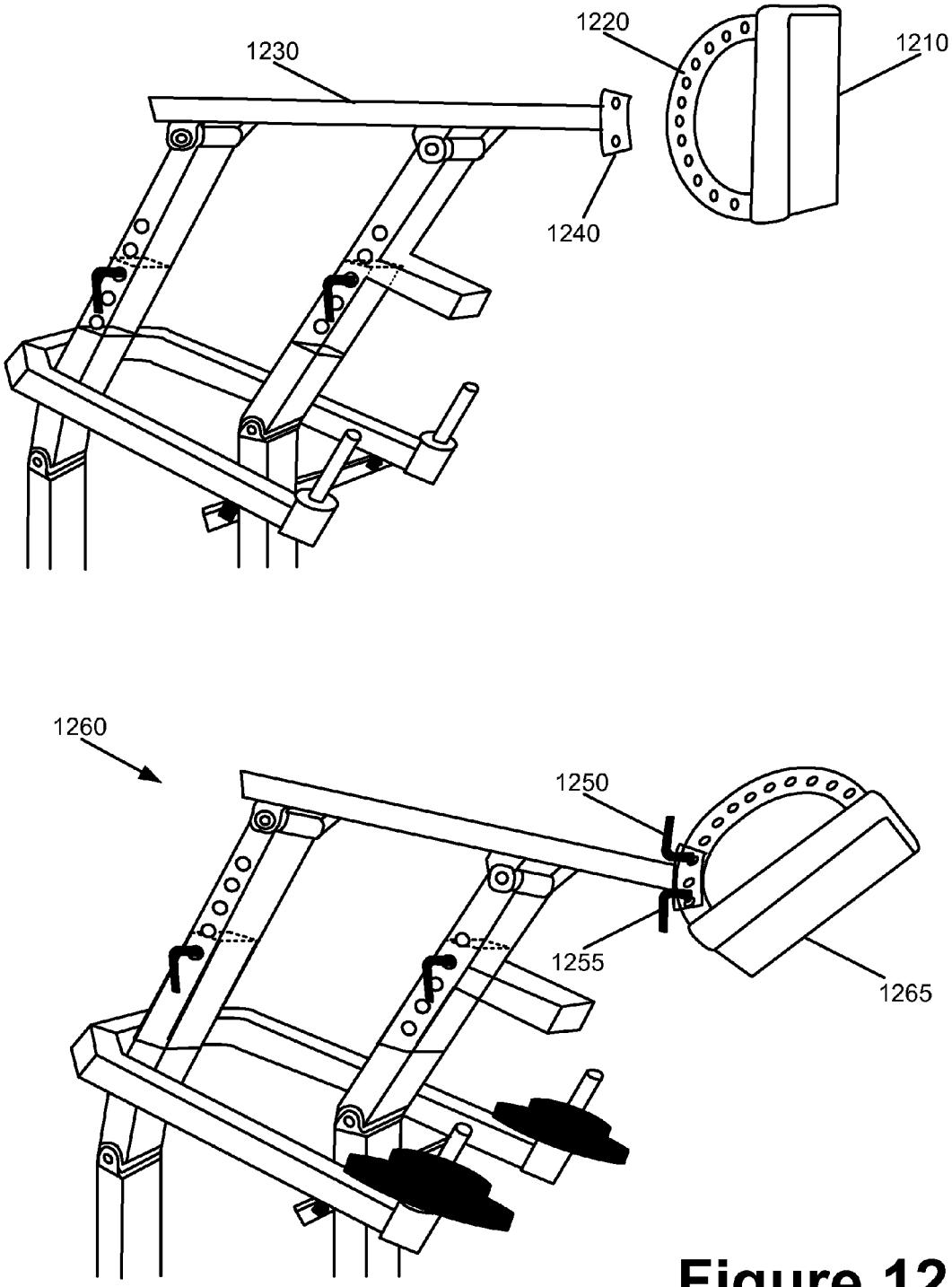
FIG. 12 illustrates a strike pad with an adjustable angle in accordance with some embodiments of the strike weight training machine.

FIG. 12 illustrates a strike pad 1210 with an adjustable angle in accordance with some embodiments of the strike weight training machine. In FIG. 12, the strike pad 1210 includes a semi-circular railing 1220 with a set of holes. The semi-circular railing 1220 retains a constant radius from the center of the strike pad 1210 such that the set of holes of the railing 1220 are equidistant from the center of the strike pad 1210.

The support member 1230 includes a stabilizing bracket 1240 that is curved similar to the railing 1220. The stabilizing bracket 1240 includes two holes that are spaced to align with any two holes on the railing 1220 that are at least one hole apart. Using two pins 1250 and 1255 to secure the angle of the strike pad 1210, the angle of the strike pad 1210 may be adjusted such that strike techniques with upward or downward motions may be trained on the machine.

For instance at 1260, the frame extensions of the strike training machine have been adjusted to align with the motion of an upward extending strike. At 1260, the strike pad 1265 has been angled downwards to create a point of impact that is aligned with the angle of the upward extending strike.

The bracket 1240 and railing 1220 configuration allow the strike pad to be angled up to 75 degrees below and up to 75 degrees above the x-axis extension of the support member. It should be apparent to one of ordinary skill in the art that various other means may be used to adjust the angle of the strike pad. For example, some embodiments provide a lockable hinge mechanism that allows the angle of the strike pad to be adjusted and locked in a similar manner as that shown in FIG. 12. Moreover, it should be apparent that some embodiments of the strike training machine allow the angle of the strike pad to be adjusted in addition to adjusting the height of the strike pad as shown in FIGS. 8 and 9.

Figure 13:
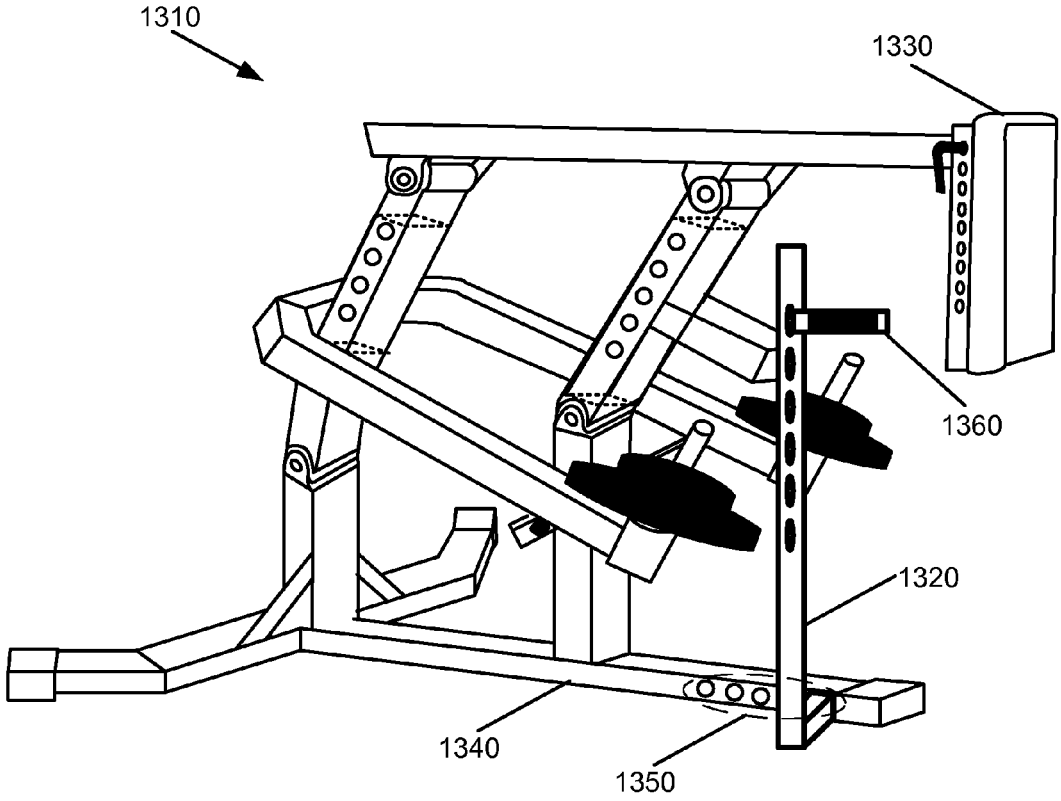
FIG. 13 illustrates the strike training machine of some embodiments with a stabilizing bar.

FIG. 13 illustrates yet another feature that enhances functionality of the strike training machine of some embodiments. Specifically, FIG. 13 illustrates the strike training machine 1310 of some embodiments with a stabilizing bar 1320. The stabilizing bar 1320 assists the actor in maintaining balance while throwing strikes against the strike pad 1330.

The stabilizing bar 1320 vertically extends from the base 1340 of the frame where it is secured using a pin locking mechanism to holes 1350 that are drilled on either side of the base 1340. In this manner, the stabilizing bar 1320 may be placed on either side of the base 1340. Some embodiments include two stabilizing bars 1320 with one on each side of the base 1340.

In some embodiments, the stabilizing bar 1320 includes a rectangular or circular tube with a cushioned gripping surface along the vertical extension of the bar 1320. The stabilizing bar 1320 may be straight, curved, or segmented to provide different grip positions. In some embodiments, the stabilizing bar 1320 includes holes along its vertical extension. A horizontally extending peg 1360 is placed into any of the vertically extending holes in order to provide additional grip positions.

The stabilizing bar 1320 extends five feet from the ground level though the height may be adjustable from two to six feet. In some embodiments, the angle of the stabilizing bar 1320 is adjustable to bring the bar 1320 closer to or further away from the user.

The actor uses one arm to grab the stabilizing bar 1320 to maintain his body position while throwing strikes with the other. For example, when throwing kicks it is often difficult to maintain a body position with only one leg. Accordingly, the actor may repeatedly train a kick using one leg while retaining balance using the other leg and by grabbing the stabilizing bar 1320.

The stabilizing bar 1320 is also useful to simulate striking while grabbing an opponent. For instance, the actor simulates grabbing an opponent by grabbing the stabilizing bar 1320 with one arm and then simulates striking by using the other arm or leg to strike against the strike pad 1330.

In some embodiments, the stabilizing bar 1320 provides isometric training for the arm grabbing the stabilizing bar 1320. Specifically, the angle and position of the arm grabbing the stabilizing bar 1320 remains constant and the muscles of the grabbing arm perform static contractions to maintain body position when strikes are thrown. The different grip position provide different forms of isometric training.

It should be apparent to one of ordinary skill in the art that each of the adjustable configurations illustrated in FIGS. 8-13 may be included individually or in any combination with other adjustable configurations in a single strike weight training machine. Accordingly, some embodiments provide a strike training machine that provides the adjustable height strike pad illustrated in FIGS. 8 and 9 and the adjustable height frame extensions illustrated in FIGS. 10 and 11. Some other embodiments provide the adjustable height strike pad of FIGS. 8 and 9, the adjustable angle strike pad of FIG. 12, and the adjustable height frame extensions of FIGS. 10 and 11.

Figure 14:
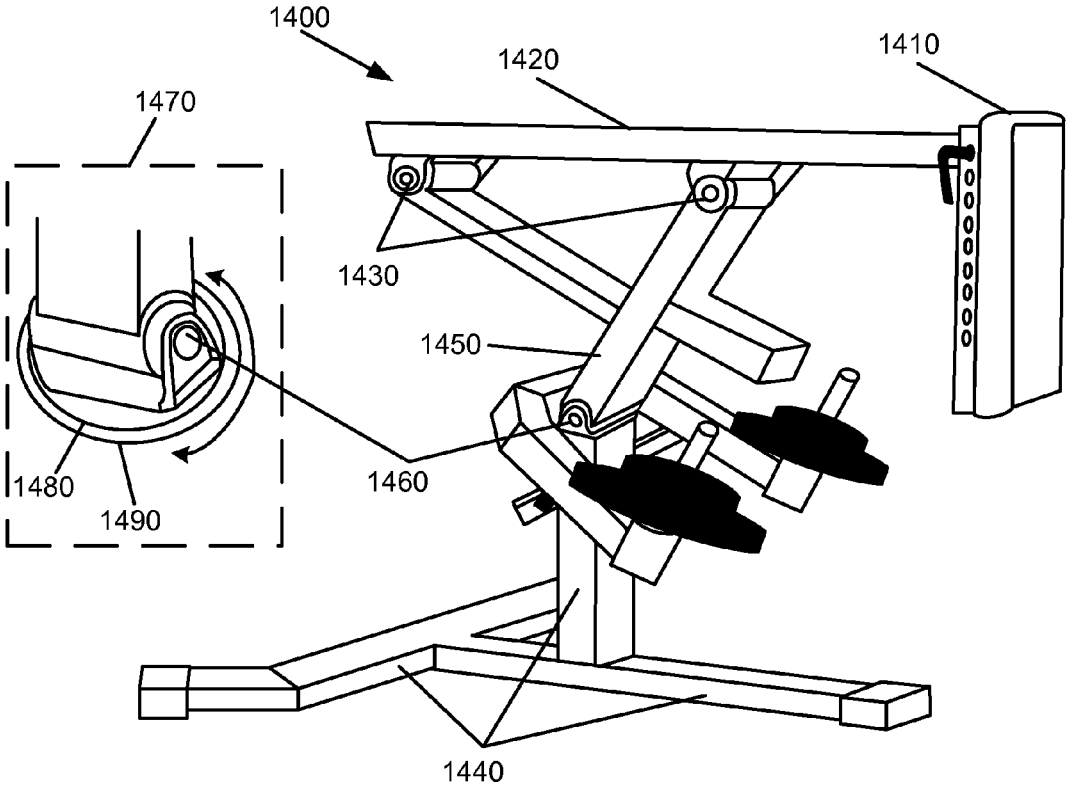
FIG. 14 illustrates an alternate implementation for the strike training machine of some embodiments.

Furthermore, it should be apparent that the strike training machine may be implemented differently in some other embodiments. FIG. 14 illustrates an alternate implementation for the strike training machine of some embodiments.

The strike training machine 1400 includes strike pad 1410, support member 1420, rotating hinges 1430, and frame 1440 as before in FIG. 1. However, the strike training machine 1400 has been implemented with only a single frame extension 1450 that is connected to the frame 1440 using one rotating hinge 1460. As before, the rotating hinge 1460 rotates about the y-axis to provide axial movement for the strike pad 1410 and support member 1420 along the x-axis.

In some embodiments, the rotating hinge 1460 also rotates about its base (similar to a "lazy Susan"). As shown in the magnified view 1470 of the hinge 1460, the bottom bracket of the hinge 1460 is attached to a disc 1480 that rotates about a second disc 1490. Such rotation about the hinge 1460 allows for additional variation in the movement of the strike pad 1410 and support member 1420. Specifically, such an implementation allows for training of looping or semi-circular strikes that are thrown across the actor's body. For example, when an actor throws a roundhouse kick, the kick begins from one side of the actor's body and ends at the opposite side of the body. By allowing rotation about the base of the hinge 1460, the strike training machine of some embodiments is able to replicate and provide resistance for the entire striking motion of the roundhouse kick and other looping or semi-circular strikes.

While the invention has been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

I claim:

1. A strike training machine comprising:

a frame for stabilizing said machine;

first and second frame extensions that couple to the frame at a first set of rotating hinges;

a support member that couples to said frame extensions at a second set of rotating hinges; and a strike pad coupled to the support member, wherein a push force applied to the strike pad causes said frame extensions to rotate about the first and second set of rotating hinges, wherein said rotation of the frame extensions moves the strike pad along a trajectory that follows a trajectory of said striking motion.

2. The strike training machine of claim 1 further comprising a weight assembly that supports an adjustable amount of weight for providing resistance against the push force.

3. The strike training machine of claim 2, wherein said weight assembly couples to the second frame extension and rotates in combination with said second frame extension.

4. The strike training machine of claim 3, wherein said weight assembly is located behind the strike pad to produce a counter push force to the push force applied to the strike pad.

5. The strike training machine of claim 3, wherein said weight assembly produces a downward force based on the amount of supported weight, wherein said downward force provides resistance against said push force applied against said strike pad.

6. The strike training machine of claim 3, wherein said frame comprises a bar that is located beneath the weight assembly, wherein said weight assembly rests atop of said bar to determine a default position for the machine when not in use.

7. The strike training machine of claim 1, wherein each of the first and second frame extensions comprises an inner shaft and an outer shaft for adjusting a height of the frame extension, wherein adjusting heights of the frame extensions alters a moving trajectory of the strike pad.

8. The strike training machine of claim 1, wherein the strike pad comprises an adjustable height mechanism to adjust a height of the strike pad relative to the support member.

9. The strike training machine of claim 1, wherein the strike pad comprises an adjustable angling mechanism to adjust an angle of the strike pad relative to the support member.

10. The strike training machine of claim 1 further comprising a stabilizing bar that vertically extends from the frame, wherein said stabilizing bar is used to maintain a body position when performing strikes against said strike pad.

11. A strike training machine comprising:

a first beam comprising a cushion to move along an x-axis when absorbing a push force at said cushion;

a second beam coupled to said first beam at a first rotating hinge;

a frame stabilizing said machine about a ground surface, the frame comprising at least one third beam extending upward from the ground surface and coupling to the second beam at a second rotating hinge, a fourth beam coupled to said second beam for supporting a user specified amount of weight, wherein said weight produces a force against said second beam to oppose the push force at said cushion, wherein the push force moves the first beam along the x-axis and the second beam along a y-axis based on a rotation of the first beam relative to the second beam at the first rotating hinge and rotation of the second beam relative to the third beam at the second rotating hinge.

12. The strike training machine of claim 11, wherein said second beam comprises a pair of shafts and a pin for adjusting a height of said second beam, wherein adjusting the height of said second beam modifies movement of the first beam along the y-axis.

13. The strike training machine of claim 11, wherein said first beam further comprises an adjustable height mechanism for adjusting a height of the strike pad relative to the first beam.

14. A weight training machine for performing strike training comprising:

a weight assembly for supporting a user determined amount of weight;

a rotating support beam coupled to said weight assembly, the rotating support beam comprising (i) a first end that rotates about a first pivot point and (ii) a second end opposite to the first end; and a strike pad coupled to the second end of the rotating support beam at a second pivot point, said strike pad for absorbing a push force generated by a striking motion, wherein said push force causes said support beam to rotate away from the push force when said push force is sufficient to overcome the amount of weight supported by said weight assembly, and wherein the strike pad moves along a y-axial plane based on rotation of the rotating support beam about the first pivot point and the strike pad moves about an x-axial plane based on rotation of the strike pad at the first pivot point.

15. The weight training machine of claim 14, wherein rotation of said support beam moves said strike pad along a trajectory of the striking motion.

16. The weight training machine of claim 14, wherein said striking motion comprises at least one of a punch, kick, elbow strike, knee strike, and throwing motion.

17. The weight training machine of claim 14, wherein said weight assembly provides bidirectional resistance against extraction and contraction of said striking motion.

* * * * *